US010695245B2

(12) United States Patent
Tsai

(10) Patent No.: US 10,695,245 B2
(45) Date of Patent: Jun. 30, 2020

(54) LIGHTWEIGHT MODULAR BED WITH VIBRATION MOTOR

(71) Applicant: ULIFE HEALTHCARE INC., Taichung (TW)

(72) Inventor: Chi-Lung Tsai, Taichung (TW)

(73) Assignee: ULIFE HEALTHCARE INC., Taichung (TW)

( * ) Notice: Subject to any disclaimer, the term of this patent is extended or adjusted under 35 U.S.C. 154(b) by 259 days.

(21) Appl. No.: 15/806,878

(22) Filed: Nov. 8, 2017

(65) Prior Publication Data

US 2018/0318158 A1 Nov. 8, 2018

(30) Foreign Application Priority Data

May 4, 2017 (TW) ..... 106206270 U

(51) Int. Cl.
*A61G 7/015* (2006.01)
*A61H 23/00* (2006.01)
(Continued)

(52) U.S. Cl.
CPC ..... *A61G 7/015* (2013.01); *A61H 1/005* (2013.01); *A61H 23/00* (2013.01); *A61H 23/02* (2013.01); *A61H 2201/0107* (2013.01); *A61H 2201/0142* (2013.01); *A61H 2201/0146* (2013.01); *A61H 2201/0192* (2013.01); *A61H 2203/0443* (2013.01); *A61H 2205/02* (2013.01); *A61H 2205/10* (2013.01)

(58) Field of Classification Search
CPC ..... A61G 7/015; A61G 7/002; A61G 13/08; A61H 1/005; A61H 23/02; A61H 23/00; A61H 2201/0146; A61H 2205/10; A61H 2201/0192; A61H 2201/0142; A61H 2201/0107; A61H 2205/02; A61H 2203/0443; A61H 2201/0138; A47C 17/04; A47C 20/08; A47C 19/021; A47C 20/04; F16B 12/10; F16B 12/54; F16B 2012/106; Y10S 5/915
See application file for complete search history.

(56) References Cited

U.S. PATENT DOCUMENTS

2014/0310875 A1* 10/2014 Iida ..... A61G 1/01 5/606
2015/0305510 A1* 10/2015 Tarplee ..... A47C 20/041 601/57
(Continued)

*Primary Examiner* — Samchuan C Yao
*Assistant Examiner* — Rachel H. Moon
(74) *Attorney, Agent, or Firm* — Allen, Dyer, Doppelt + Gilchrist, PA

(57) ABSTRACT

A lightweight modular bed includes a bed frame unit, a first retaining unit, a second retaining unit, a supporting web unit, a vibration motor, and a cover patch. The first and second retaining units are coupled to two lateral portions of the supporting web unit to permit a web body of the supporting web unit to be fully stretched. A peripheral margin of the cover patch is secured to a boundary of a predetermined mounting region of the web body to permit a motor body of the vibration motor to be disposed therebetween. When the web body is fully stretched, top and bottom surfaces of the motor body are brought into abutting engagement with the cover patch and the predetermined mounting region, respectively.

7 Claims, 9 Drawing Sheets

(51) Int. Cl.
*A61H 23/02* (2006.01)
*A61H 1/00* (2006.01)

(56) References Cited

U.S. PATENT DOCUMENTS

| | | | | |
|---|---|---|---|---|
| 2016/0113410 | A1* | 4/2016 | Ermalovich | A47C 21/006<br>248/205.1 |
| 2017/0318977 | A1* | 11/2017 | Rawls-Meehan | A47C 27/00 |
| 2017/0348186 | A1* | 12/2017 | Garcia | A61H 23/02 |

* cited by examiner

LIGHTWEIGHT MODULAR BED WITH VIBRATION MOTOR

CROSS-REFERENCE TO RELATED APPLICATION

This application claims priority from Taiwanese utility model patent application no. 106206270, filed on May 4, 2017.

FIELD

The disclosure relates to a modular bed, and more particularly, to a lightweight modular bed with a vibration motor.

BACKGROUND

An adjustable bed facilitates a patient to access or leave the bed, and may be used to assist a user to lie in different comfortable positions. Recently, some adjustable beds may also include vibration motors for massaging a patient or a user.

As shown in FIGS. 1 and 2, a conventional modular bed 1 for a mattress 10 is shown to include a bed frame unit 11, a supporting board 12, and a vibration unit 13. The bed frame unit 11 includes a plurality of legs 111 and a frame body 112 supported by the legs 11. The supporting board 12 is mounted on the frame body 112 for supporting the mattress 10, and has a mounting region 121 having an inner margin 120 which defines a through hole 122. The vibration unit 13 is mounted on the mounting region 121, and includes a soft pad 131, an upper soft retaining piece 132, a lower soft retaining piece 134, a vibration motor 133, and a covering piece 135. The soft pad 131 is disposed in the through hole 122 and between the mattress 10 and the upper soft retaining piece 132. The upper and lower soft retaining pieces 132, 134 are configured to secure and enclose the vibration motor 133 therebetween. The covering piece 135 has a boundary secured to the margin region 120, and is configured to abut the lower soft retaining piece 134 to force the vibration motor 133 to abut toward the mattress 10, so as to transmit vibration of the vibration motor 133 to the mattress 10, thereby providing vibrating massage to a user. The conventional modular bed including the supporting board 12 is heavy and inconvenient for transportation.

SUMMARY

Therefore, an object of the disclosure is to provide a lightweight modular bed with a vibration motor.

According to the disclosure, a lightweight modular bed includes a base frame unit, a first retaining unit, a second retaining unit, a supporting web unit, a vibration motor, and a cover patch. The bed frame unit includes a front leading bar and a rear trailing bar which are opposite to each other in a longitudinal direction. Each of the front leading bar and the rear trailing bar extends in a transverse direction relative to the longitudinal direction to terminate at a first end segment and a second end segment. The first retaining unit has a first front segment and a first rear segment, which are opposite to each other, and which are coupled to the first end segments of the front leading bar and the rear trailing bar, respectively. The second retaining unit has a second front segment and a second rear segment, which are opposite to each other, and which are coupled to the second end segments of the front leading bar and the rear trailing bar, respectively. The supporting web unit is configured to be fully stretched on the bed frame unit in a stretching position, and includes a web body and two lateral portions. The web body has a predetermined mounting region. The two lateral portions are at opposite sides of the web body, and are coupled to the first and second retaining units, respectively, so as to permit the web body to be fully stretched between the first and second retaining units. The vibration motor includes a motor body which includes a top surface and a bottom surface that is disposed on the predetermined mounting region. The cover patch has a peripheral margin secured to a boundary of the predetermined mounting region to cover the motor body, and is configured such that when the web body is fully stretched, the top and bottom surfaces of the motor body are brought into abutting engagement with the cover patch and the predetermined mounting region, respectively.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
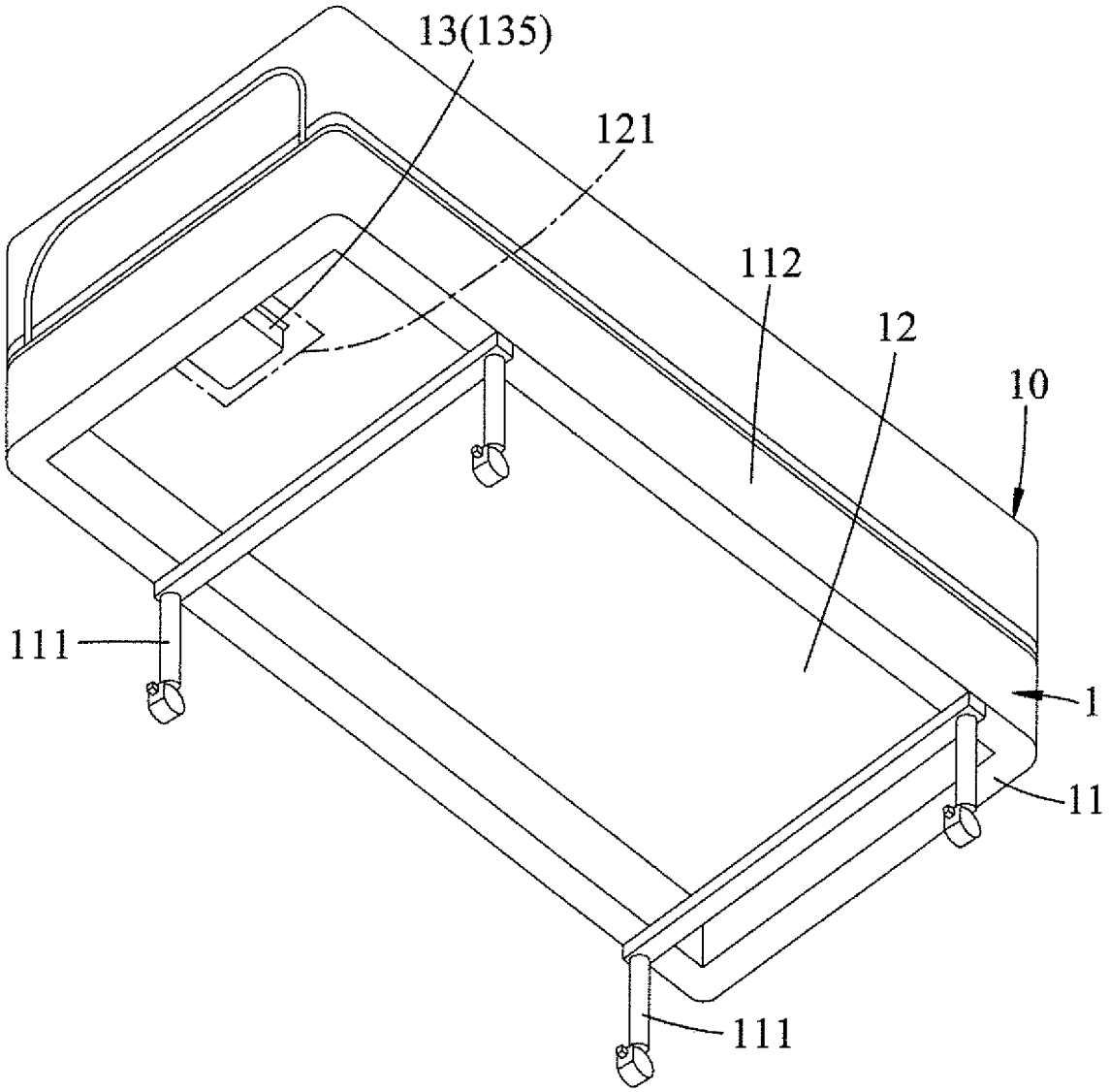
FIG.1 PRIOR ART
FIG. 1 is a bottom perspective view of a conventional modular bed.
Figure 2:
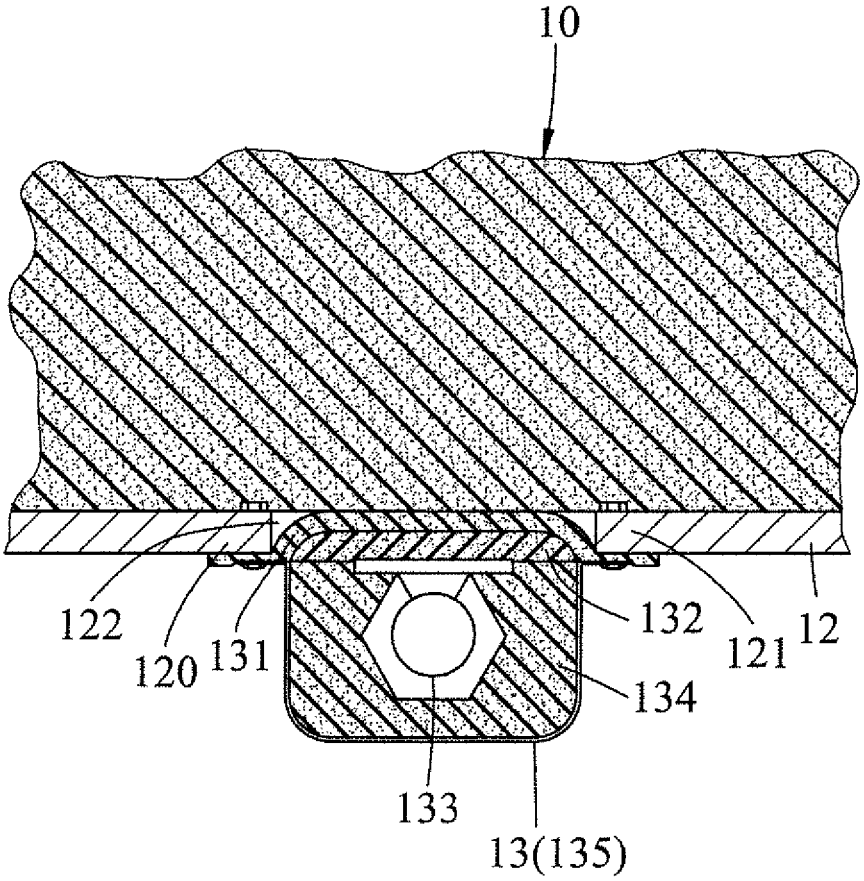
FIG.2 PRIOR ART
FIG. 2 is a fragmentary cross-sectional view of the conventional modular bed.

Before the disclosure is described in greater detail, it should be noted that where considered appropriate, reference numerals have been repeated among the figures to indicate corresponding or analogous elements, which may optionally have similar characteristics.

Figure 3:
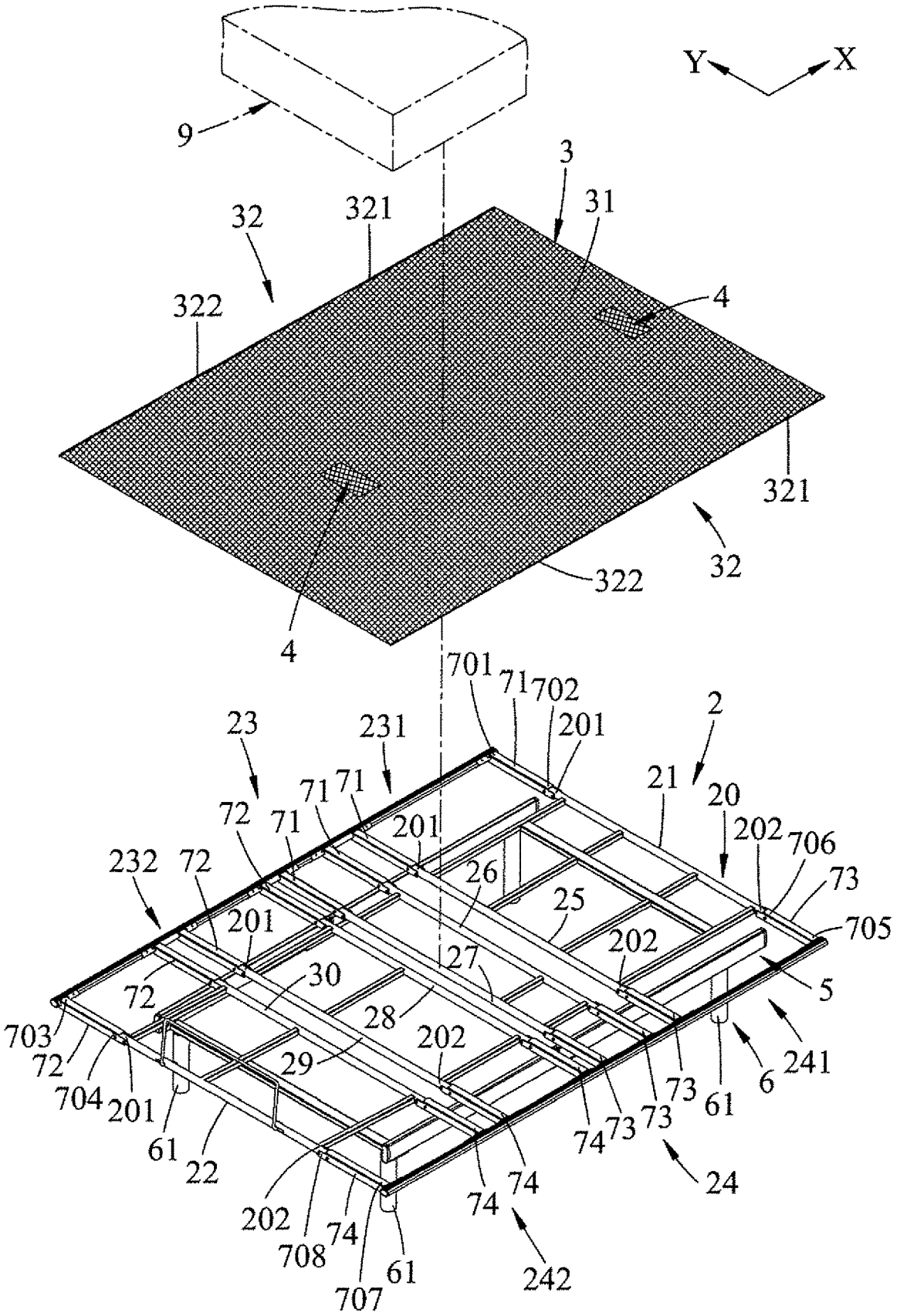
FIG. 3 is an exploded perspective view of a lightweight modular bed according to a first embodiment of the disclosure.
Figure 6:
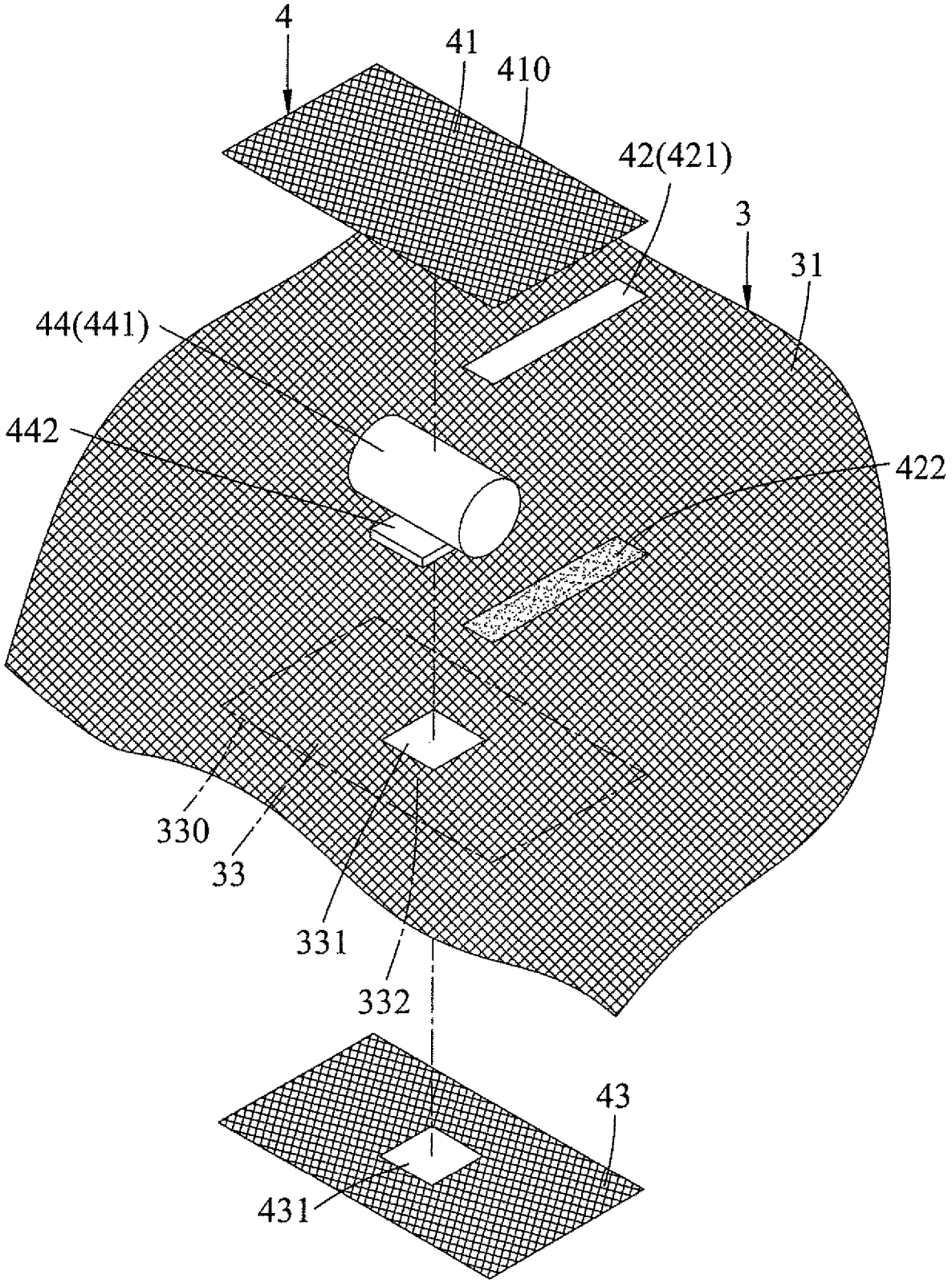
FIG. 6 is a fragmentary exploded enlarged perspective view illustrating the vibration motor in the lightweight modular bed.

Referring to FIG. 3, a lightweight modular bed for supporting a mattress 9 according to a first embodiment of the disclosure is shown to include a bed frame unit 2, a first retaining unit 23, a second retaining unit 24, a supporting web unit 3, and a vibration unit 4. As shown in FIG. 6, the vibration unit 4 includes a vibration motor 44 and a cover patch 41.

Referring back to FIG. 3, the bed frame unit 2 includes a support frame 20 having a front leading bar 21 and a rear trailing bar 22 which are opposite to each other in a longitudinal direction (X). Each of the front leading bar 21 and the rear trailing bar 22 extends in a transverse direction (Y) relative to the longitudinal direction (X) to terminate at a first end segment 201 and a second end segment 202.

In this embodiment, the support frame 20 includes six intermediate bars 25, 26, 27, 28, 29, 30 each extending in the transverse direction (Y) to terminate at a first end segment 201 and a second end segment 202.

In this embodiment, the bed frame unit 2 further includes a base frame 5 on which the support frame 20 is mounted, and a leg assembly 6 configured to elevate and place the base frame 5 in a stationary state, and including a plurality of legs 61.

The first retaining unit 23 has a first front segment 231 and a first rear segment 232, which are opposite to each other, and which are coupled to the first end segments 201 of the front leading bar 21 and the rear trailing bar 22, respectively.

The second retaining unit 24 has a second front segment 241 and a second rear segment 242, which are opposite to each other, and which are coupled to the second end segments 202 of the front leading bar 21 and the rear trailing bar 22, respectively.

Figure 5:
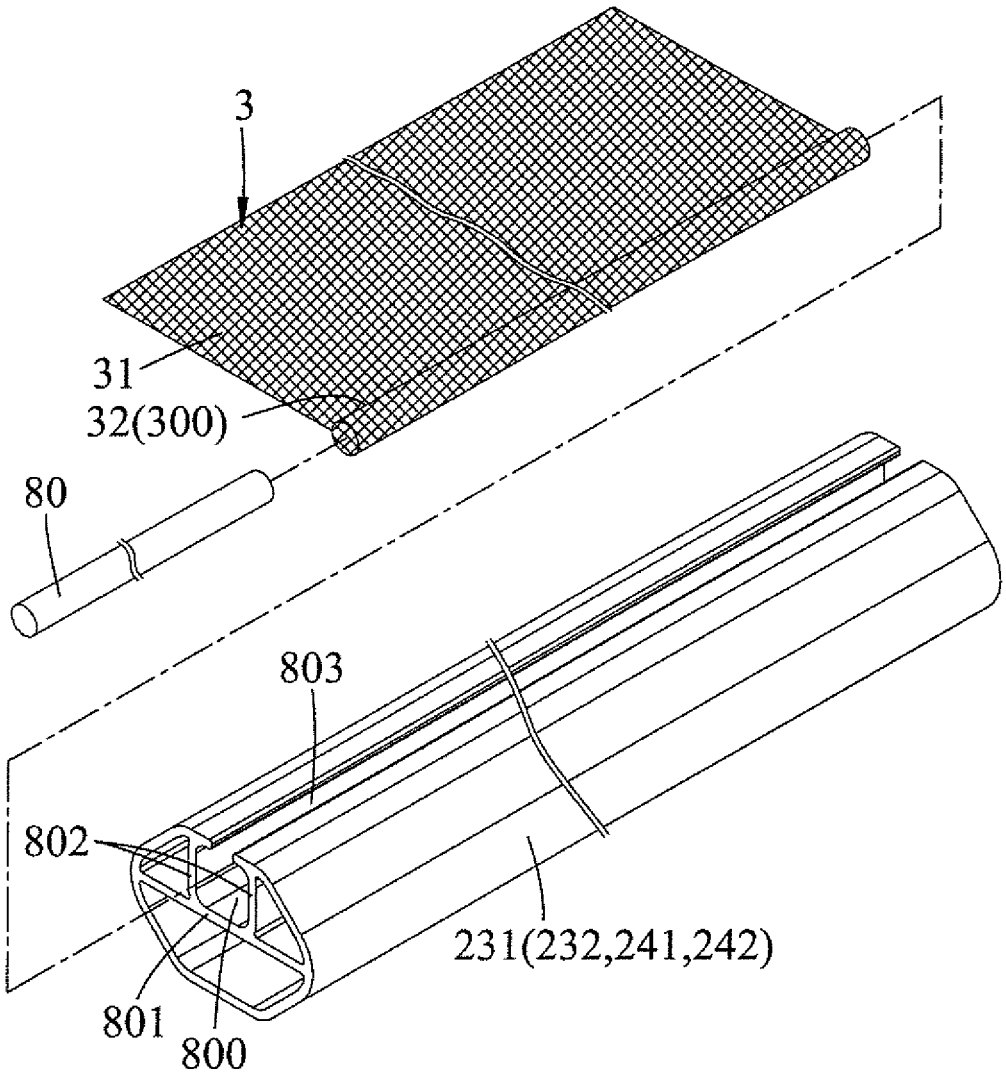
FIG. 5 is an exploded enlarged view illustrating how a lateral portion of a web body in the lightweight modular bed is led into an elongated retaining groove of a retaining unit.

In this embodiment, as shown in FIG. 5, each of the first front segment 231, the first rear segment 232, the second front segment 241, and the second rear segment 242 has an elongated retaining groove 800 which has an elongated base 801 and two elongated sidewalls 802 that extend respectively from two opposite edges of the elongated base 801 and toward each other to form an elongated slit 803.

In this embodiment, the lightweight modular bed further includes four first front links 71, four first rear links 72, four second front links 73, and four second rear links 74.

The first front links 71 are displaced from each other in the longitudinal direction (X), and each of the first front links 71 has a first front connected end 701 connected to the first front segment 231, and a first front pivot end 702 pivotally mounted to the first end segment 201 of a corresponding one of the front leading bar 21 and the intermediate bars 25, 26, 27.

The first rear links 72 are displaced from each other in the longitudinal direction (X), and each of the first rear links 72 has a first rear connected end 703 connected to the first rear segment 232, and a first rear pivot end 704 pivotally mounted to the first end segment 201 of a corresponding one of the rear trailing bar 22 and the intermediate bars 28, 29, 30.

The second front links 73 are displaced from each other in the longitudinal direction (X), and each of the second front links 73 has a second front connected end 705 connected to the second front segment 241, and a second front pivot end 706 pivotally mounted to the second end segment 202 of a corresponding one of the front leading bar 21 and the intermediate bars 25, 26, 27.

The second rear links 74 are displaced from each other in the longitudinal direction (X), and each of the second rear links 74 has a second rear connected end 707 connected to the second rear segment 242, and a second rear pivot end 708 pivotally mounted to the second end segment 202 of a corresponding one of the rear trailing bar 22 and the intermediate bars 28, 29, 30.

With the provision of the first front links 71, the first rear links 72, the second front links 73, and the second rear links 74, each of the first and second retaining units 23, 24 is angularly movable from a non-stretching position to the stretching position. When the first or second retaining unit 23 or 24 is in the non-stretching position (not shown), the first or second retaining unit 23 or 24 is remote from the ground. When the first or second retaining unit 23 or 24 is in the stretching position, as shown in FIG. 3, the first or second retaining unit 23 or 24 is close to the ground.

The supporting web unit 3 is configured to be fully stretched on the bed frame unit 2 in a stretching position, and includes a web body 31 having predetermined mounting region 33 (see FIGS. 4 and 6), and two lateral portions 32 (see FIG. 3). The lateral portions 32 are at opposite sides of the web body 31, and are coupled to the first and second retaining units 23, 24, respectively, so as to permit the web body 31 to be fully stretched between the first and second retaining units 23, 24.

In this embodiment, when each of the first and second retaining units 23, 24 is displaced to the stretching position, the web body 31 is fully stretched on the support frame 20.

The web body 31 can be made from any stretchable materials with relatively high strength, such as hemp, nylon, etc., and may be woven or knitted fabrics, non-woven fabrics, open mesh fabrics, etc. In this embodiment, the web body 31 is made from an open mesh fabric.

In this embodiment, each of the lateral portions 32 is enlarged compared to the web body 31, and has a front segment 321 and a rear segment 322 which are configured such that once the front and rear segments 321, 322 of each of the lateral portions 32 have been led into two corresponding ones of the elongated retaining grooves 800 of the first front segment 231, the first rear segment 232, the second front segment 241, and the second rear segment 242, respectively, the front and rear segments 321, 322 will be prevented from pulling out of the two corresponding ones of the elongated slits 803, respectively.

As shown in FIG. 5, each of the lateral portions 32 is in the form of a tubular sleeve 300, and the lightweight modular bed further comprising two reinforced rods 80 each of which is configured to be inserted into the tubular sleeve 300 of the lateral portions 32 to ensure the corresponding tubular sleeve 300 be retained in the corresponding elongated retaining groove 800 when each of the first and second retaining units 23, 24 is displaced to the stretching position from the non-stretching position.

Figure 7:
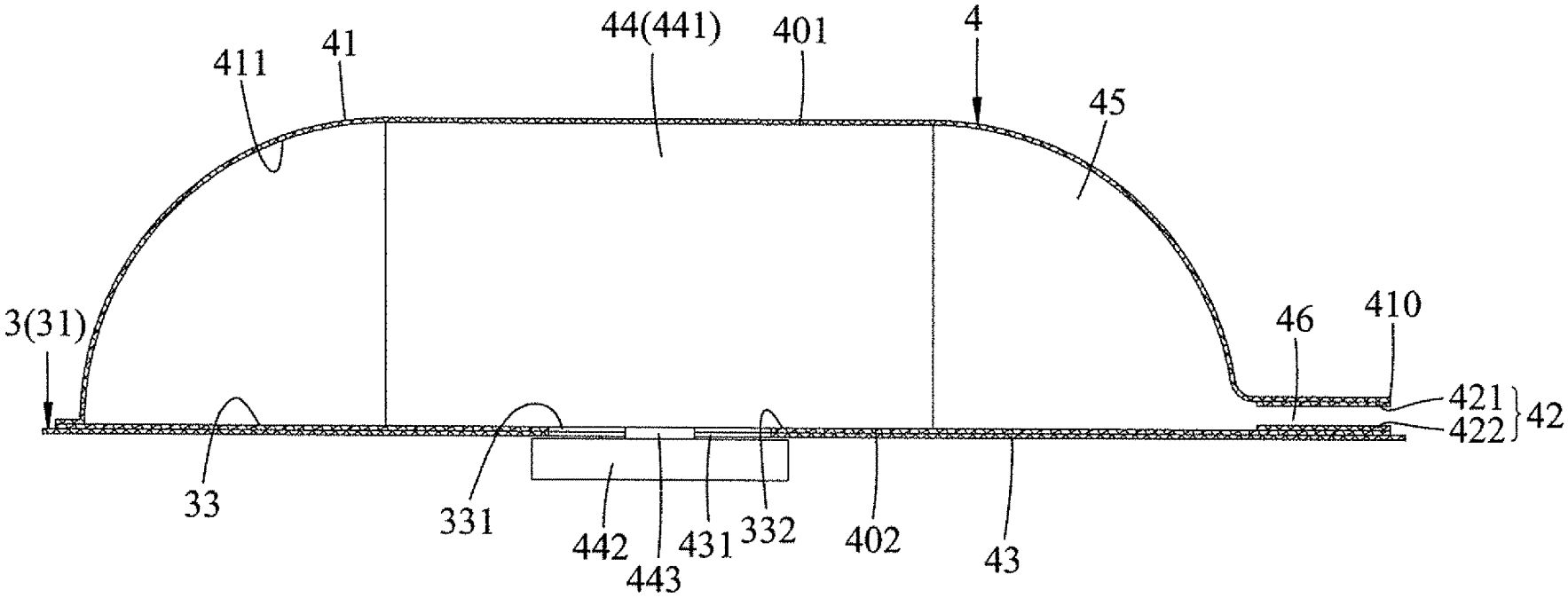
FIG. 7 is a fragmentary cross-sectional view illustrating the vibration motor enclosed in the web body of the lightweight modular bed.

As shown in FIGS. 6 and 7, the vibration motor 44 includes a motor body 441 which includes a top surface 401 and a bottom surface 402 that is disposed on the predetermined mounting region 33.

In this embodiment, the vibration motor 44 further includes a base 442 and a neck 443 which interconnects the base 442 and the bottom surface 402 of the motor body 441.

The cover patch 41 has a peripheral margin 410 secured to a boundary 330 of the predetermined mounting region 33 to cover the motor body 441, and is configured such that when the web body 31 is fully stretched, the top and bottom surfaces 401, 402 of the motor body 441 are brought into abutting engagement with the cover patch 41 and the predetermined mounting region 33, respectively. An inner space 45 is defined between the cover patch 41 and the predetermined mounting region 33. The cover patch 41 may be a single or multi-layer structure, and may be made from a material the same as that of the web body 31. Alternatively, the cover patch 41 may be made from a different material from the web body 31. In this embodiment, the cover patch 41 is a single layer of open mesh fabric.

In this embodiment, in order to prevent wear of the cover patch 41 due to the vibration of the vibration motor 44, the cover patch 41 is lined with an abrasion resistant material, as denoted by numeral 411 shown in FIG. 7.

In this embodiment, the predetermined mounting region 33 has an inner marginal region 332 defining a through opening 331 which is configured to permit the base 442 to be led through the through opening 331 to thereby allow the base 442 to be brought into abutting engagement relative to the inner marginal region 332 once the neck 443 is disposed in the through opening 331.

In this embodiment, the peripheral margin 410 of the cover patch 41 is detachably secured to the boundary 330 of the predetermined mounting region 33.

In this embodiment, the vibration unit 4 further includes a hook-and-loop fastener 42 disposed to permit the peripheral margin 410 of the cover patch 41 to be detachably secured to the boundary 330 of the predetermined mounting region 33. The hook-and-loop fastener 42 includes a hook portion 421 and a loop portion 422. In other embodiments, the hook-and-loop fastener 42 may be replaced by a male-and-female fastener (not shown).

As shown in FIG. 7, in this embodiment, the peripheral margin 410 of the cover patch 41 is not entirely sewn with the boundary 330 of the predetermined mounting region 33, and an access opening 46 is left to permit access of the vibration motor 44 to the inner space 45. After the vibration motor 44 is installed, the access opening 46 is closed by the hook-and-loop fastener 42.

In this embodiment, the vibration unit 4 further includes a reinforcing piece 43 which is secured to the predetermined mounting region 33, and which is configured to simulate the predetermined mounting region 33 so as to be sandwiched between the predetermined mounting region 33 and the base 442. As shown in FIGS. 6 and 7, the reinforcing piece 43 has a through opening 431 in line with the through opening 331. The reinforcing piece 43 may be made from the same or different material from the web body 31. In this embodiment, the reinforcing piece 43 is made from the same material as the web body 31. With the provision of the reinforcing piece 43, the vibration motor 44 is less likely to shift inside the inner space 45 so as to permit the vibration motor 44 to provide better vibrating massage effect.

In this embodiment, in order to further stabilize the vibration motor 44, the vibration unit 4 may further include a bottom cover patch (not shown) which is secured to the web body 31 to cover the reinforcing piece 41 and the base 442. The bottom cover patch may be made from the same or a different material from the web body 31.

In this embodiment, the lightweight modular bed includes two of the vibration units 4 for providing a vibrating massage to the user's head and legs, and the web body 31 includes two of the predetermining mounting regions 33. In another embodiment, three or more of the vibration units 44 can be mounted in the lightweight modular bed based on the user's requirement.

Figure 4:
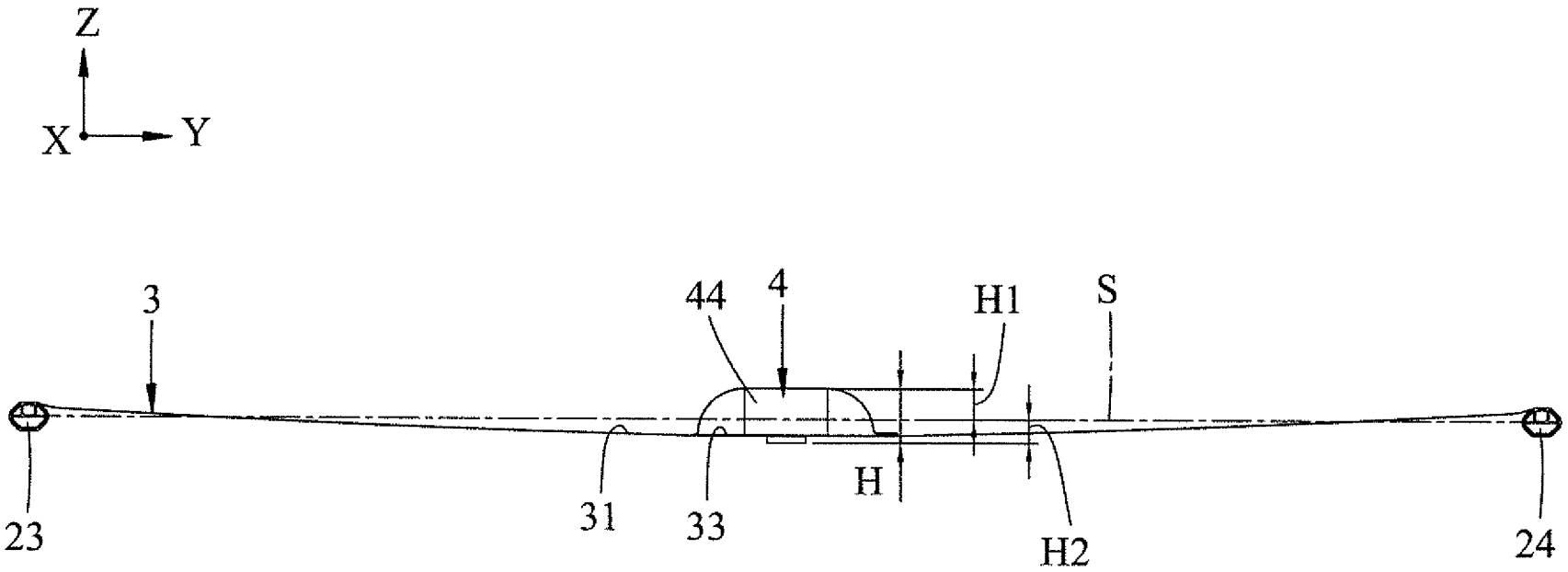
FIG. 4 is a schematic cross-sectional view illustrating a position of a vibration motor in the lightweight modular bed.

As shown in FIG. 4, the first and second retaining units 23, 24 cooperatively define therebetween a horizontal plane (S) normal to an upright direction (Z) transverse to both the longitudinal and transverse directions (X, Y). The vibration motor 44 in the upright direction (Z) has a height (H) with a first section (H1) and a second section (H2) which are above and beneath the horizontal plane (S), respectively. A ratio of the first section (H1) to a second section (H2) ranges from 3:1 to 2:1.

Figure 8:
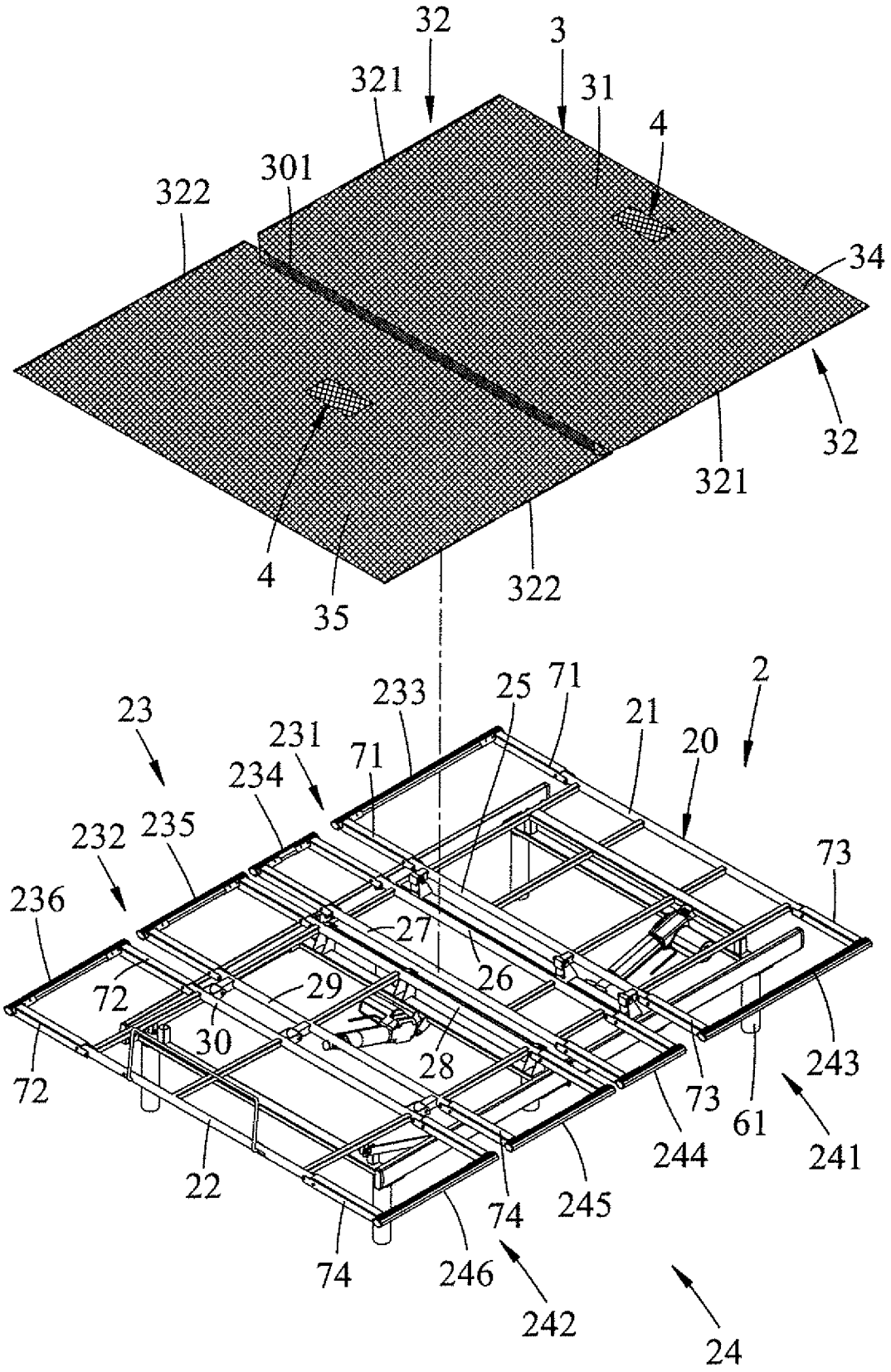
FIG. 8 is an exploded perspective view of a lightweight modular bed according to a second embodiment of the disclosure.
Figure 9:
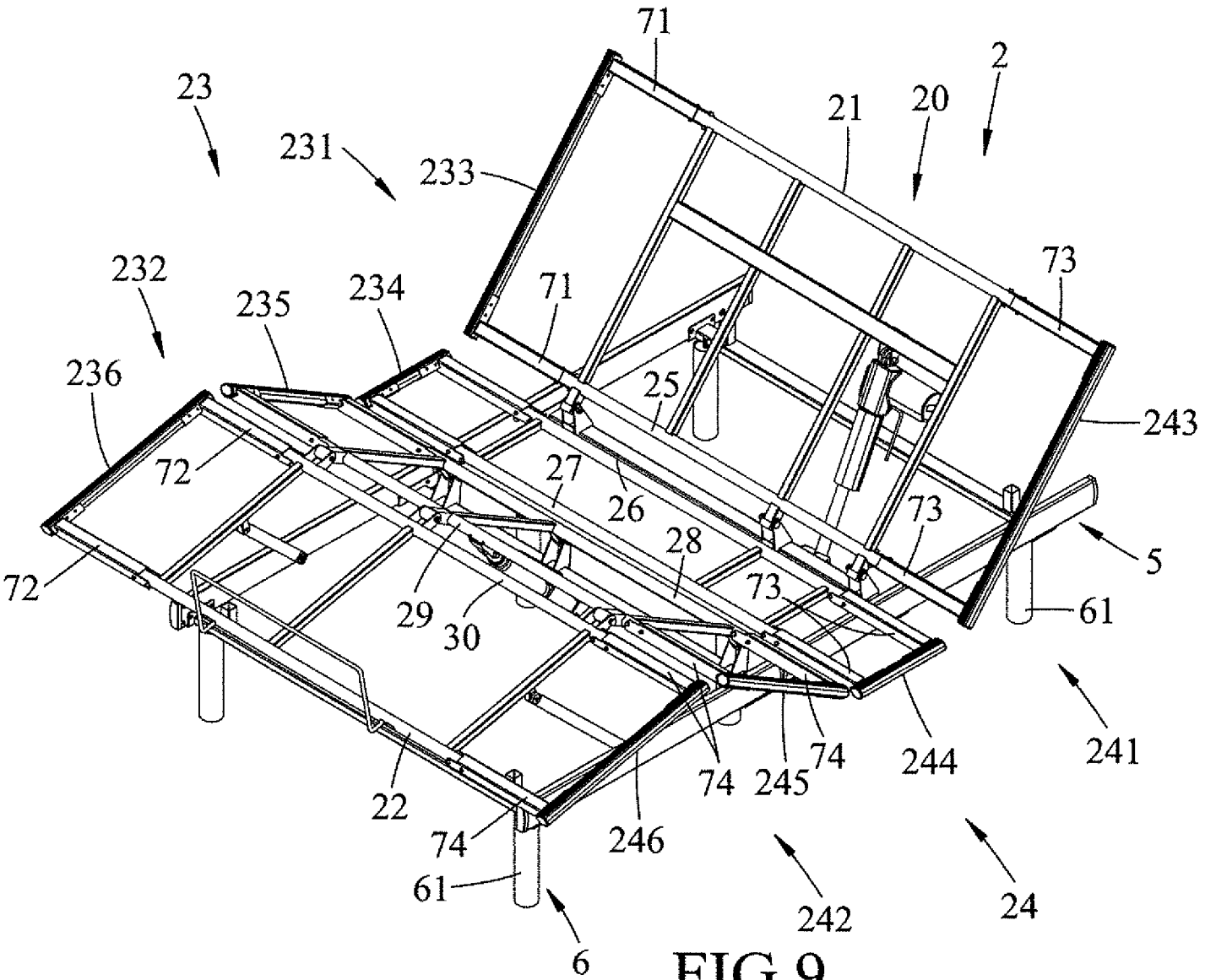
FIG. 9 is a perspective view illustrating that a bed frame unit in the lightweight modular bed of the second embodiment can be adjusted.

FIGS. 8 and 9 illustrate a lightweight modular bed according to a second embodiment of the disclosure. The second embodiment is similar to the first embodiment, except that the support frame 20 is adjustable.

The web body 31 includes a front web portion 34 with the front segments 321, and a rear web portion 35 with the rear segments 322. The front and rear web portions 34, 35 can be secured to each other by a hook-and-loop fastener 301.

In addition, the first front and rear segments 231, 232 are disparate from each other, and the second front and rear segments 241, 242 are disparate from each other. The first front segment 231 has two separate regions 233, 234 configured to retain one of the front segments 321. The first rear segment 232 has two separate regions 235, 236 configured to retain one of the rear segments 322. The second front segment 241 has two separate regions 243, 244 configured to retain the other one of the front segments 321. The second rear segment 242 has two separate regions 245, 246 configured to retain the other one of the rear segments 322.

Each of the reinforced rods 80 shown in FIG. 5 is cut into four separate segments (not shown), which are respectively retained inside the four regions 233, 234, 235, 236, or the four regions 243, 244, 245, 246.

In this embodiment, the front leading bar 21, together with the intermediate bar 25 and the regions 233, 243, is pivotably mounted relative to the base frame 5, and is liftable from a head normal position (FIG. 8) to a head elevated position (FIG. 9).

The intermediate bars 26, 27 are secured on the base frame 5.

The intermediate bar 29, together with the intermediate bar 28 and the regions 235, 245, is pivotably mounted relative to the base frame 5, and is liftable from a leg normal position (FIG. 8) to a leg elevated position (FIG. 9).

The intermediate bar 30 is pivotally coupled to the intermediate bar 29 so as to permit the intermediate bar 30, together with the rear trailing bar 22 and the regions 236, 246, to be lifted when the intermediate bar 29 is displaced to the leg elevated position.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A lightweight modular bed comprising:

a bed frame unit including a front leading bar and a rear trailing bar which are opposite to each other in a longitudinal direction, each of said front leading bar and said rear trailing bar extending in a transverse direction relative to the longitudinal direction to terminate at a first end segment and a second end segment;

a first retaining unit having a first front segment and a first rear segment, which are opposite to each other, and which are coupled to said first end segments of said front leading bar and said rear trailing bar, respectively;

a second retaining unit having a second front segment and a second rear segment, which are opposite to each other, and which are coupled to said second end segments of said front leading bar and said rear trailing bar, respectively;

a supporting web unit configured to be fully stretched on said bed frame unit in a stretching position, and including a web body having a predetermined mounting region, and two lateral portions which are at opposite sides of said web body, and which are coupled to said first and second retaining units, respectively, so as to permit said web body to be fully stretched between said first and second retaining units;

a vibration motor including a motor body which includes a top surface and a bottom surface that is disposed on said predetermined mounting region; and a cover patch which has a peripheral margin secured to a boundary of said predetermined mounting region to cover said motor body, and which is configured such that when said web body is fully stretched, said top and bottom surfaces of said motor body are brought into abutting engagement with said cover patch and said predetermined mounting region, respectively.

2. The lightweight modular bed according to claim 1, wherein said vibration motor further includes a base and a neck which interconnects said base and said bottom surface of said motor body, said predetermined mounting region having an inner marginal region defining a through opening which is configured to permit said base to be led through said through opening to thereby allow said base to be brought into abutting engagement relative to said inner marginal region once said neck is disposed in said through opening.

3. The lightweight modular bed according to claim 2, further comprising a reinforcing piece which is secured to said predetermined mounting region, and which is configured to simulate said predetermined mounting region so as to be sandwiched between said predetermined mounting region and said base.

4. The lightweight modular bed according to claim 1, wherein said cover patch is lined with an abrasion resistant material.

5. The lightweight modular bed according to claim 1, wherein said peripheral margin of said cover patch is detachably secured to said boundary of said predetermined mounting region.

6. The lightweight modular bed according to claim 5, further comprising a hook-and-loop fastener disposed to permit said peripheral margin of said cover patch to be detachably secured to said boundary of said predetermined mounting region.

7. The lightweight modular bed according to claim 1, wherein said first and second retaining units cooperatively define therebetween a horizontal plane normal to an upright direction, said vibration motor in the upright direction having a height with a first section and a second section which are above and beneath said horizontal plane, respectively, a ratio of said first section to a second section ranging from 3:1 to 2:1.

* * * * *